US007158088B2

(12) United States Patent
Atchiriki

(10) Patent No.: US 7,158,088 B2
(45) Date of Patent: Jan. 2, 2007

(54) MAGNETIC SOURCE OSCILLATORS UNIVERSAL PASSIVE ANTENNA

(76) Inventor: Codjo Atchiriki, 06 BP 1321, Cotonou (BJ)

( * ) Notice: Subject to any disclaimer, the term of this patent is extended or adjusted under 35 U.S.C. 154(b) by 0 days.

(21) Appl. No.: 11/100,265

(22) Filed: Apr. 5, 2005

(65) Prior Publication Data

US 2006/0220978 A1 Oct. 5, 2006

(51) Int. Cl.
*H01Q 9/16* (2006.01)

(52) U.S. Cl. ..... 343/793; 343/795; 343/882

(58) Field of Classification Search ..... 343/793, 343/795, 878, 702, 700 MS, 882
See application file for complete search history.

(56) References Cited

U.S. PATENT DOCUMENTS 5,691,735 A * 11/1997 Butland et al. ..... 343/795
6,281,858 B1 * 8/2001 Jennetti et al. ..... 343/818
6,600,454 B1 * 7/2003 Moilanen ..... 343/795
2003/0189526 A1 * 10/2003 Gustafson ..... 343/793
2005/0237255 A1 * 10/2005 Zhang et al. ..... 343/795

* cited by examiner

*Primary Examiner*—Trinh Dinh
*Assistant Examiner*—Huedung Mancuso
(74) *Attorney, Agent, or Firm*—Schmeiser, Olsen & Watts LLP

(57) ABSTRACT

A device concerning a magnetic source oscillators universal passive antenna to receive or transmit electromagnetic waves from low frequencies to hyper frequencies. The device is made with a special dipolar system that contains two identical parts (15) and (16) that are assembled by a metal support (7). This metal support (7) can have a variable and adaptable form. Each identical part (15) and (16) of the special dipolar system is made with a triangular magnet (3), a triangular special conductor or semiconductor (4) from which pointed edge is a conducting point (5) or (6). A wave-pick-up-system made with two cables (11), (12), and a cable entrance (14). The acting principle of the antenna formed with the special dipolar system and the wave-pick-up-system, is sealed in a filled insulating material box (17) and raised on a tripod support (18) and (19) that can be very variable and adaptable with the purpose to fix the antenna to function without disturbance. The device of the invention is effective in the frequency range from low frequencies to hyper frequencies and very effective for satellites communication.

3 Claims, 6 Drawing Sheets

MAGNETIC SOURCE OSCILLATORS UNIVERSAL PASSIVE ANTENNA

BACKGROUND OF THE INVENTION

The present invention concerns a device to receive or transmit electromagnetic waves in the frequency range from low frequencies to hyper frequencies. My previous invention concerning generated oscillators antennas presents disadvantages because of its necessity of electric power to function. The device of the present invention helps to overcome these disadvantages.

DISCLOSURE OF THE INVENTION

In a first description, this device is indeed made with a special dipolar system which oscillators are magnetically generated with the help of the incident waves and a wave-pick-up-system. The special dipolar system becomes a powerful electric dipole with emission can easily be picked up by a wave-pick-up-system.

In concrete device:

The special dipolar system is made with two identical parts that are assembled by a metal support which form can be very variable. Each identical part of the special dipolar system is made with a magnet of triangular form, a special conductor or semiconductor of triangular form where the three sides of the triangle can have different sizes and with a small conducting point raised on one pointed edge of the conductor or semiconductor where the oscillating electric charges can be concentrated.

The wave-pick-up-system is made with two cables and a cable entrance. The acting principle of the antenna made with the special dipolar system and the wave-pick-up-system is sealed in a filled insulating material box and raised on a tripod support to form the complete antenna.

DETAILED DESCRIPTION OF EMBODIMENTS OF THE INVENTION

Figure 1:
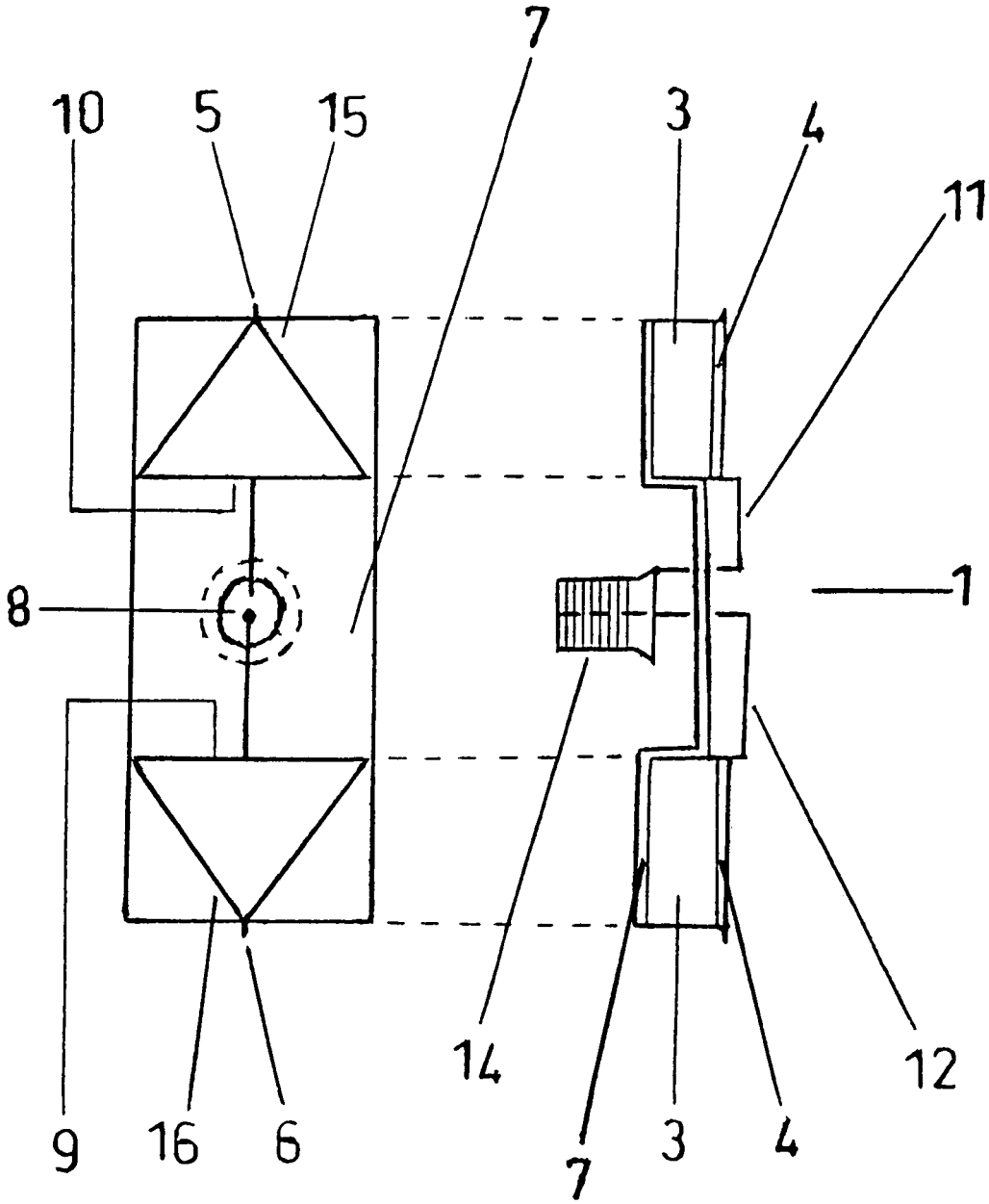
FIG. 1 represents the acting principle of the antenna.

In reference to the figures, the main components of the antenna are the following:

The special dipolar system in FIG. 1 made with two identical parts (15) and (16) that are assembled by a metal support (7) which form is very variable and adaptable. Each identical part (15) and (16) of the special dipolar system is made with a triangular magnet (3) and a triangular special conductor or semiconductor (4) from which pointed edge is a conducting point (5) or (6).

The wave-pick-up-system in FIG. 1 is made with the two cables (11) and (12) and the cable entrance (14). The acting principle of the antenna (1) is made with the special dipolar system and the wave-pick-up-system.

Figure 2:
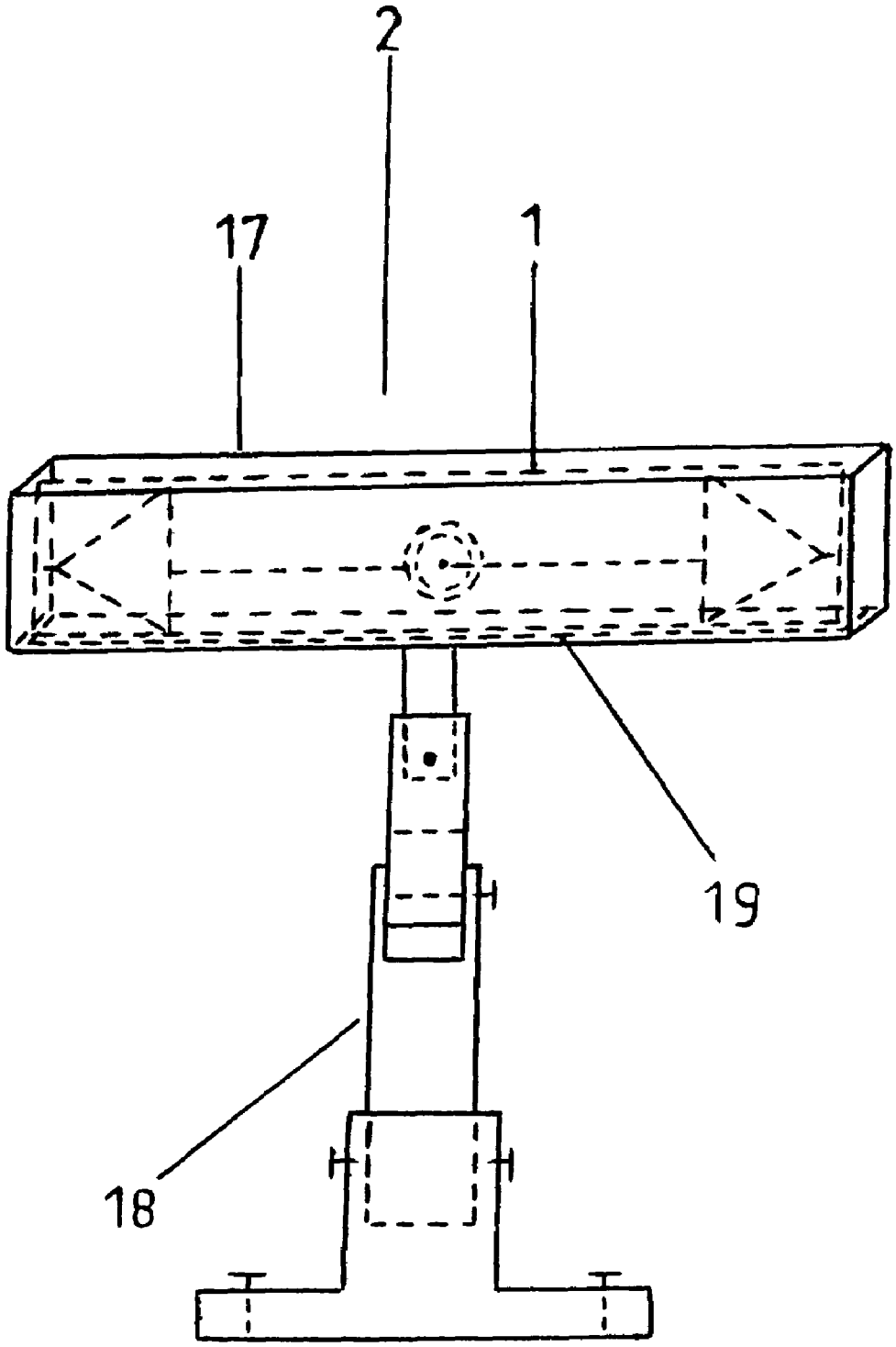
FIG. 2 represents the complete antenna.
Figure 3:
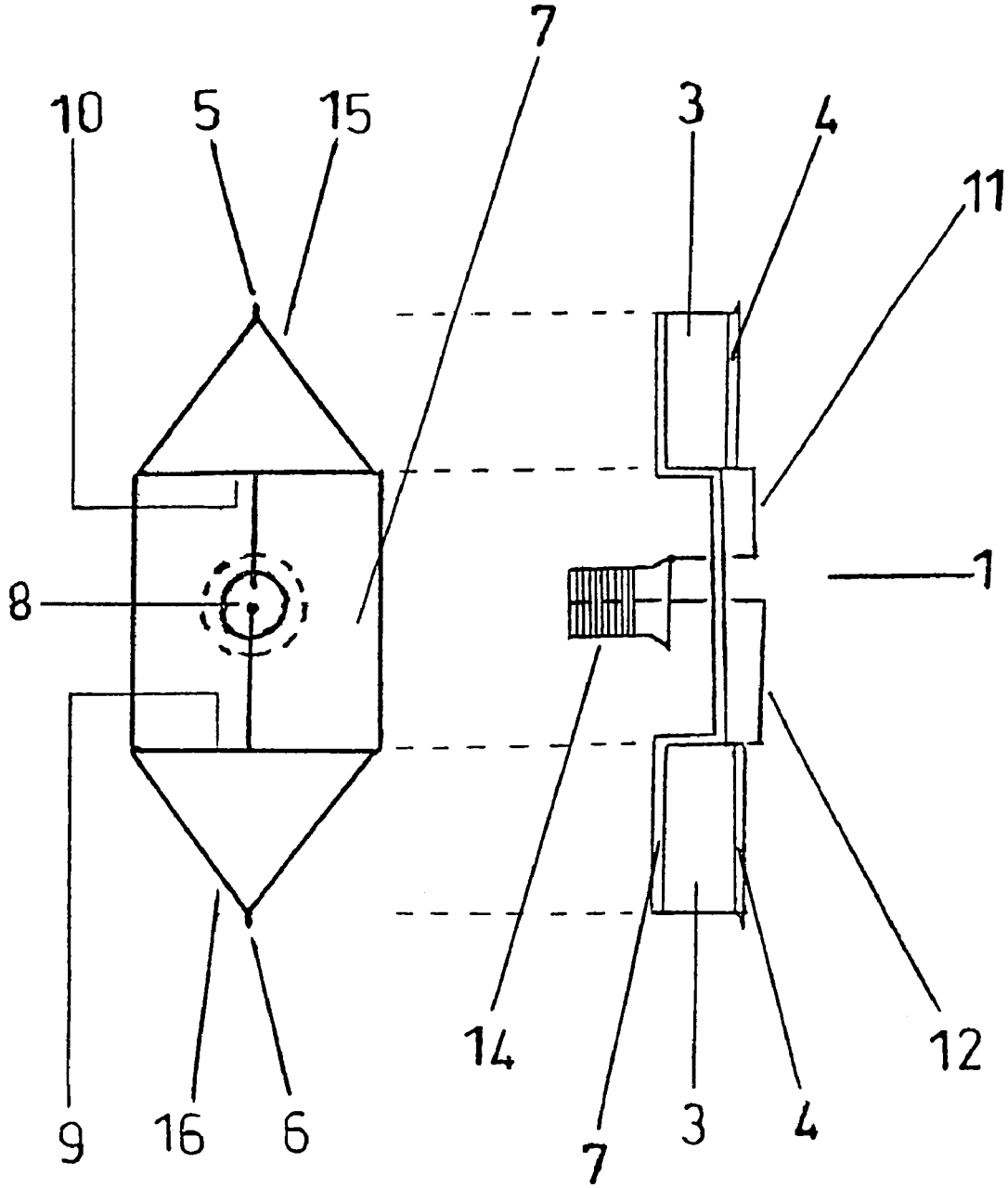
FIG. 3 represents a non limitative variant of FIG. 1.
Figure 4:
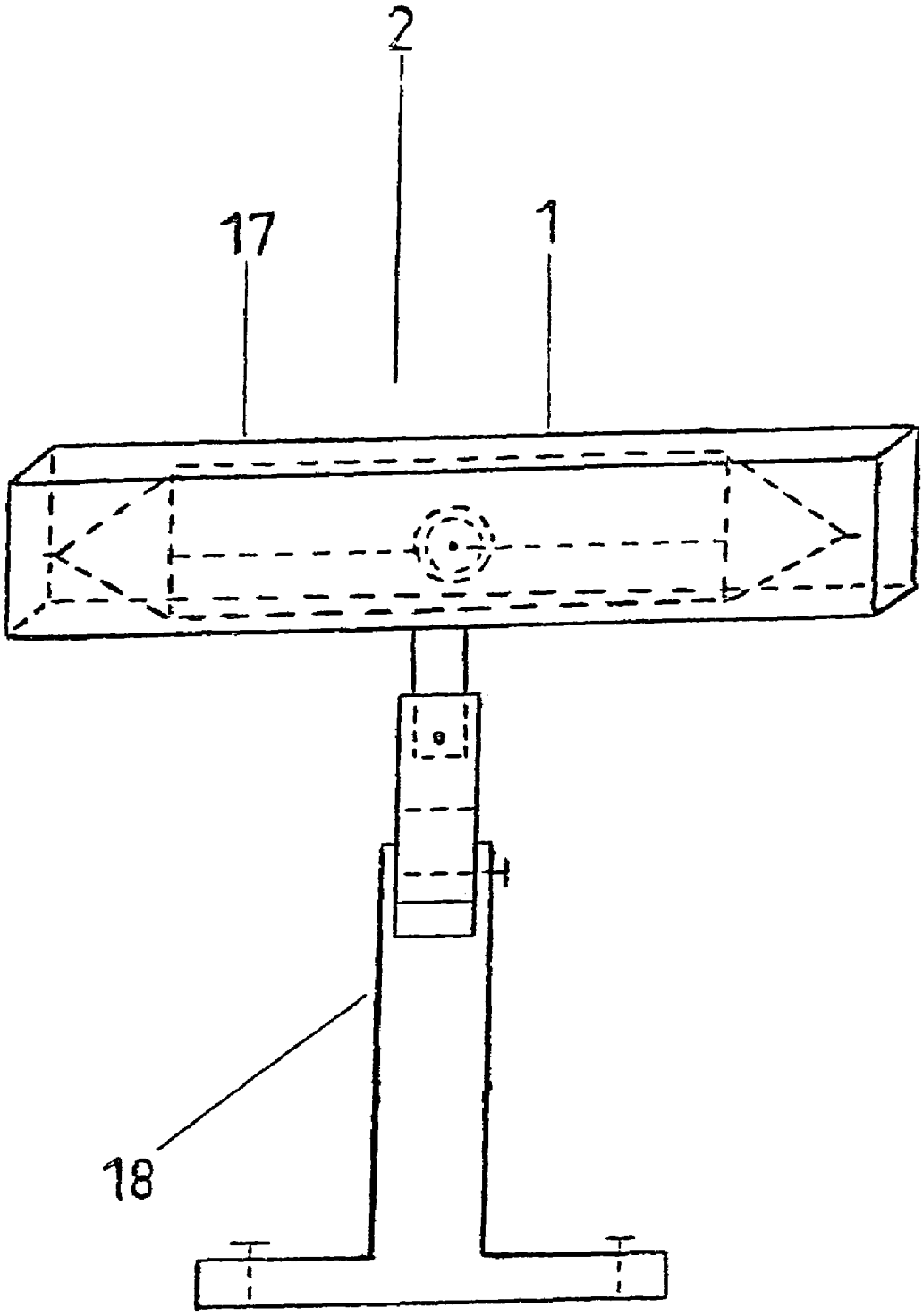
FIG. 4 represents a non limitative variant of FIG. 2.

As represented in FIG. 2, the acting principle of the antenna (1) is sealed in a filled insulating material (17) that insulates it from outside and seals together the different components of the acting principle (1). The sealed insulating box (17) containing the acting principle (1) is then raised on a tripod support (18) and (19) that are vary variable, adaptable, flexible, multi-dimensional rotary, and with the purpose to fix the antenna to make it able to receive the waves without disturbance.

The incident waves that come orthogonally on the surface of the special conductor or semiconductor (4) transform the pointed conducting edge (5) and (6) into locations of concentrated oscillating electric charges. These pointed conducting edges (5) and (6) become then a powerful electric dipole which emission is picked up by the wave-pick-up-system (11), (12) and (14).

As a non limitative example, the insulating material box (17) can have a non limitative size of 50 cm*5 cm*5 cm. The tripod (18) can have a very variable height.

The device of the invention is very effective in the frequency range from low frequencies to hyper frequencies and particularly effective for satellites communication.

Figure 5:
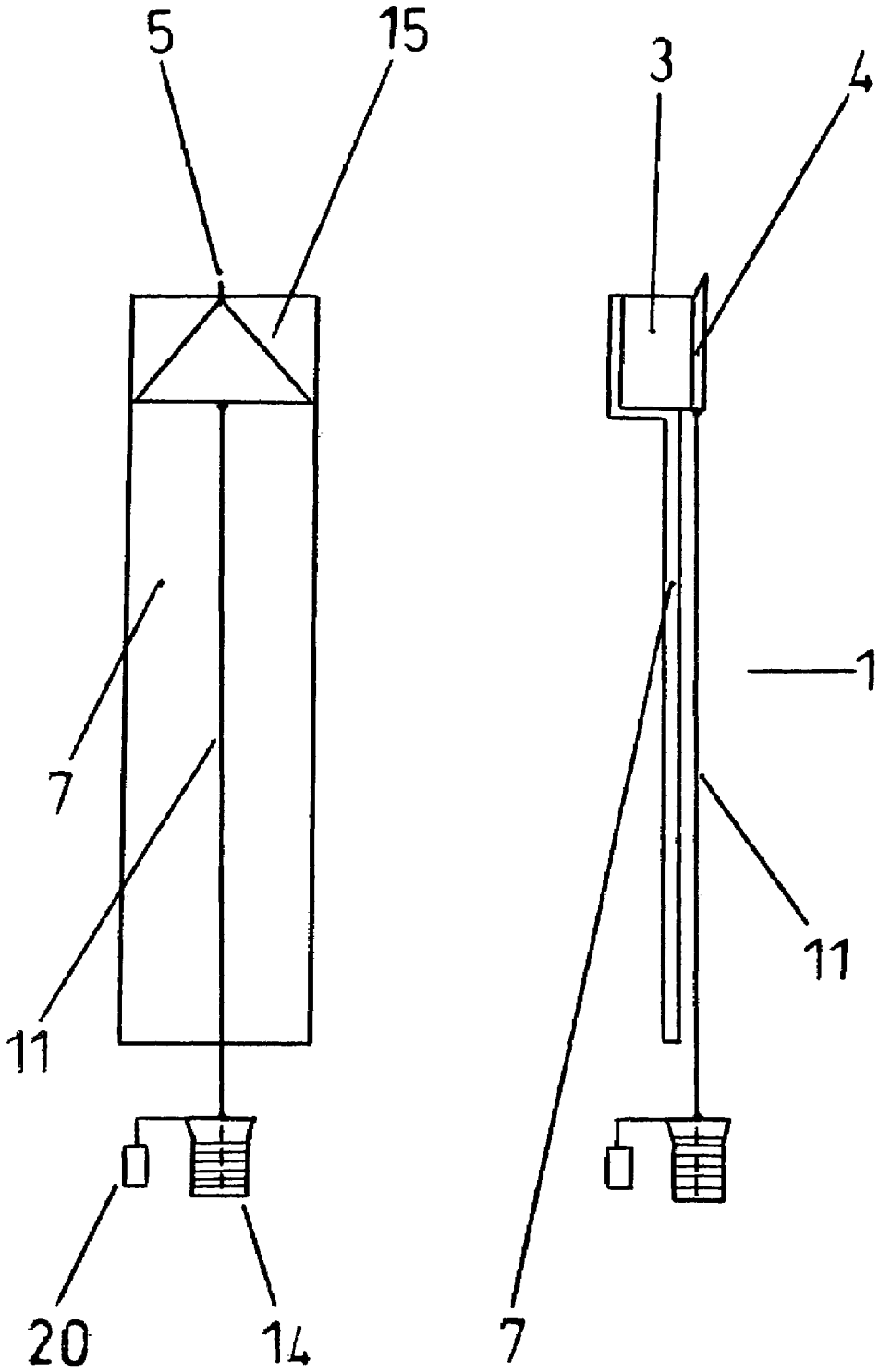
FIG. 5 represents one half part of dipolar system.

FIG. 1 can be reduced according to FIG. 5 in only one half part of dipolar system (15) with the following components:

a magnet of triangular form (3);

a special conductor or semiconductor of triangular form (4);

an electric conducting point (5) raised from one pointed edge of the semiconductor (4);

a form-shaping adaptable metal support (7);

an electric cable (11);

a cable enterance (14); and an electric mass (20) which physical form can be variable.

Figure 6:
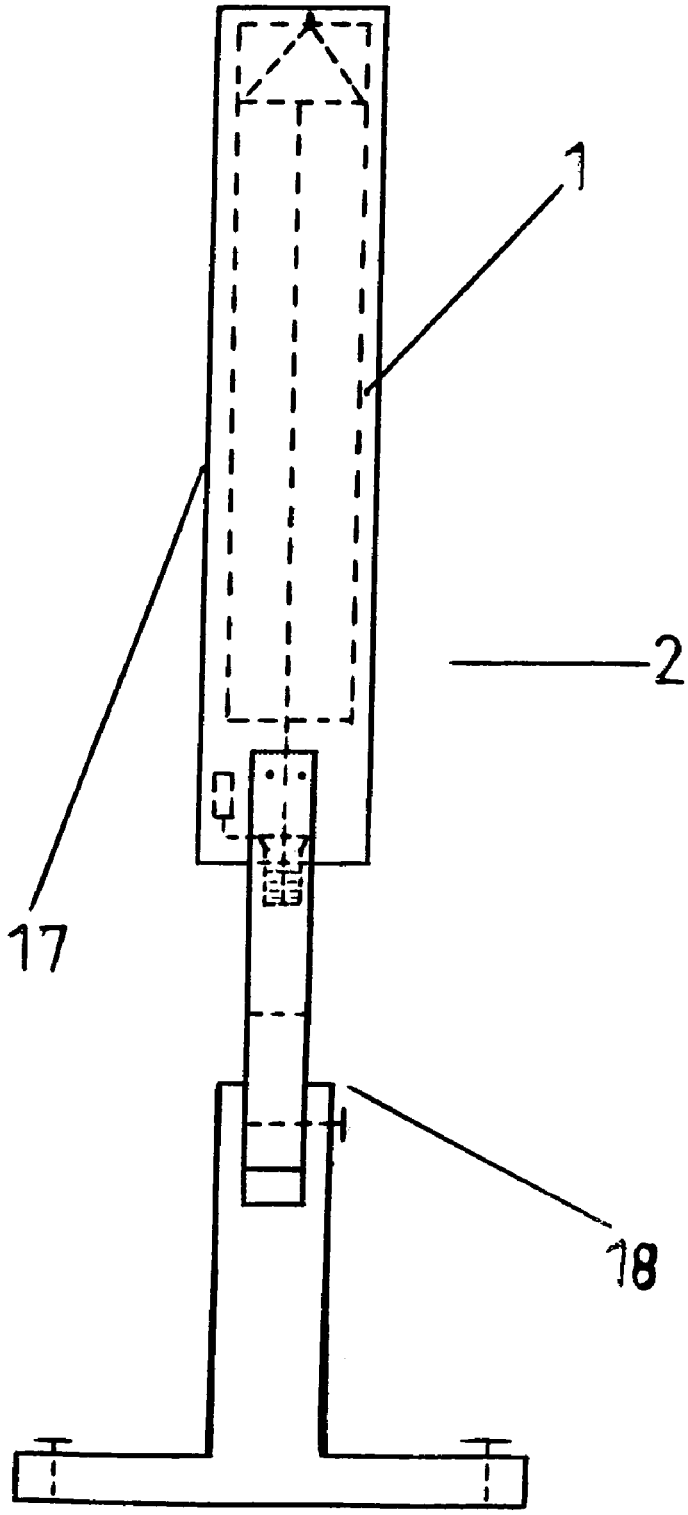
FIG. 6 represents an electric insulating material box raised on a form-shaping adaptable tripod (18) to form the complete antenna (2).

The above listed components of FIG. 5 are sealed according to FIG. 6 in an electric insulating material box (17) and raised on a form-shaping adaptable tripod (18) to form the complete antenna (2).

What is claimed is:

1. A magnetic source oscillators universal passive antenna, the complete antenna (2) made with an acting principle (1) that is conceived as described above and sealed in a filled insulating material (17), the filled insulating material (17) for insulating the acting principle (1) from the outside and for sealing together components of the acting principle (1), and raised on a tripod support (18) and (19) that is very variable, adaptable, flexible and multi-dimensional rotary for fixing the antenna to receive waves without disturbance.

2. The antenna according to claim 1, wherein the acting principle of the antenna (1) is made with:

a special dipolar system that is made with two identical parts (15) and (16) that are assembled by a metal support (7) which form is very variable; each identical part (15) and (16) is made with a triangular magnet (3), a triangular conductor or semiconductor (4) from which pointed edge is raised one conducting point (5) or (6); and a wave-pick-up-system made with two cables (11), (12) and a cable entrance (14), wherein the triangular semiconductor (4) transforms the conducting points (5) or (6) into locations of concentrated oscillating electric charges.

3. A magnetic source oscillators universal passive antenna comprising:

an acting principal, the acting principal including:

a metal support being variable and adaptable in form;

two identical parts, each part including:

a triangular conductor or semiconductor having a pointed edge, the pointed edge including a conducting point;

a triangular magnet coupled between the metal support and the triangular conductor; and a wave-pick-up-system made with two cables and a cable entrance, wherein the triangular semiconductor transforms the conducting point into locations of concentrated oscillating electric charges;

an insulating box formed of insulating material, the insulating box containing the acting principle for insulating the acting principle from the outside and sealing components of the acting principles together; and a tripod support for raising the acting principle, the tripod support being variable, adaptable, flexible and multi-dimensional rotary for fixing the antenna to receive waves without disturbance.

* * * * *